US009114543B2

(12) United States Patent
Votolato

(10) Patent No.: US 9,114,543 B2
(45) Date of Patent: Aug. 25, 2015

(54) DRAW CUT UTILITY KNIFE

(71) Applicant: Earl Votolato, Newport Beach, CA (US)

(72) Inventor: Earl Votolato, Newport Beach, CA (US)

( * ) Notice: Subject to any disclaimer, the term of this patent is extended or adjusted under 35 U.S.C. 154(b) by 0 days.

(21) Appl. No.: 14/327,957

(22) Filed: Jul. 10, 2014

(65) Prior Publication Data

US 2015/0040406 A1 Feb. 12, 2015

Related U.S. Application Data

(60) Provisional application No. 61/863,868, filed on Aug. 8, 2013.

(51) Int. Cl.
*B26B 3/08* (2006.01)
*B26B 27/00* (2006.01)

(52) U.S. Cl.
CPC ..... *B26B 27/005* (2013.01); *B26B 3/08* (2013.01)

(58) Field of Classification Search
CPC ..... B26B 3/03; B26B 3/04; B26B 3/08; B26B 27/005
USPC ..... 30/2, 294, 314, 317
See application file for complete search history.

(56) References Cited

U.S. PATENT DOCUMENTS

| | | | | |
|---|---|---|---|---|
| 4,546,510 | A * | 10/1985 | Harrison | 7/145 |
| 5,522,135 | A | 6/1996 | Votolato | |
| 6,178,640 | B1 | 1/2001 | Votolato | |
| 6,510,611 | B2 * | 1/2003 | Edwards et al. | 30/90.6 |
| 6,658,743 | B2 * | 12/2003 | Dudley et al. | 30/314 |
| 7,204,023 | B2 * | 4/2007 | Chang | 30/319 |
| 7,213,284 | B2 * | 5/2007 | Huang et al. | 7/160 |
| 2005/0060894 | A1 * | 3/2005 | Armstrong | 30/294 |
| 2005/0102844 | A1 * | 5/2005 | Addis | 30/299 |
| 2005/0217114 | A1 * | 10/2005 | Votolato | 30/2 |

* cited by examiner

*Primary Examiner* — Hwei C Payer
(74) *Attorney, Agent, or Firm* — Robert J. Lauson; Lauson & Tarver, LLP

(57) ABSTRACT

A draw cut utility knife includes an elongated handle and a head holding a blade. The handle defines a thin central portion surrounded by a flange extending around its perimeter, the central portion aligning with the blade. The head has a rounded edge from which the blade protrudes, and is formed around the blade in a manner permanently embedding it in the head. The central portion may have cut outs for reduced weight, and the head preferably includes a thickened portion for holding the blade adjacent a centrally located cut out which accommodates a user's finger. A second blade may be secured to another thickened portion of the head opposite the first blade, both blades permanently secured in the head with a rearward sharpened edge allowing the knife to be safely drawn toward a user and easily guided for a precision cut.

9 Claims, 2 Drawing Sheets

DRAW CUT UTILITY KNIFE

This application claims the benefit of the filing date of provisional application No. 61/863,868, filed on Aug. 8, 2013.

BACKGROUND

The present invention is generally related to utility knives, and more particularly to unitary molded utility knives with a blade fixed to the handle.

Many of the utility knives available are relatively complex, requiring assembly and multiple parts that can be separated by the end user. Many industries require a safe knife design that is inexpensive and minimizes the chance of foreign objects entering the product line. For example, in the food services industry, utility knives are continuously used to cut open plastic and cardboard packaging, which may contain food, supplies, or the like. With a standard utility knife, the worker changes the blade from the handle once dulled. Often, the blade change occurs during a task, where the worker does not have time to properly dispose of the blade. Thus, the worker may place the removed blade on a table or other surface, where it is soon forgotten. These loose blades may be inadvertently swept into food product, to be discovered by the end user. Workers may also accidentally come into contact with the loose blades, causing injury. Further, utility knives are often assembled with screws within the handle. These additional parts also are lost and pose contamination issues in the end product.

Yet another problem with current utility knives and box cutters is the cutting depth may be set by the worker. Thus, when cutting a cardboard box to remove product within, a blade set too deeply can score or severely damage the product.

What is needed is a utility knife which is a single, unitary structure, having no loose parts. The utility knife should also be inexpensive such that a worker may simply discard the entire knife once it dulls. The depth of the blade should also be controlled to prevent damage to product within a box being opened. The knife should be configured such that the user is able to hold it and accurately guide the blade for precision cutting of the cardboard box or other work piece. The utility knife should be easy to manufacture using a simple molding process, and which uses less plastic where material is not needed for strength, while the remainder remains sufficiently resilient for bringing adequate cutting pressure to bear.

SUMMARY

An improved draw cut utility knife includes an elongated handle for grasping the knife and a head holding a first blade. The elongated handle includes a central portion surrounded by a flange portion that extends around the perimeter of the central portion. The central portion is in planar alignment with the first blade, and the head has a rounded edge from which the first blade protrudes. When manufactured, the elongated handle and the head are formed around the first blade in a manner that the blade is permanently embedded in the head.

The central portion may include one or more cut outs. In one alternative embodiment, to provide bending resistance outside the plane of the blade the central portion may be selectively thickened. Preferably, the elongated handle narrows as it nears the head of the knife. The flange portion of the elongated handle may also have an indicator or marker to denote a force application point on the elongated handle to bring the greatest pressure to bear on the blade.

The head of the knife preferably includes a first thickened portion adjacent a central area. The central area is of thinner material like the central portion of the handle, or may be cut out entirely. The first blade is fixed in the thickened portion to securely and permanently anchor it in position. The first blade is secured in the head to have a rearward sharpened edge facing the elongated handle. In this manner, the knife can be safely drawn toward a user and easily guided for a precision cut.

In one alternative embodiment, the knife includes a second blade. The second blade is also secured to a thickened portion of the head. The second blade, like the first also has a rearward sharpened edge facing the elongated handle of the knife. In one embodiment, the second blade may be secured opposite the first blade on the head, avoiding the need to turn the knife blade down in use, thereby saving time and effort.

In order to make and use the draw cut knife to open a sealed container without harming the contents thereof, initially the knife is constructed by injection molding it an elongated handle having a rounded head. A first blade is permanently implanted into and protrudes from the head. This may be accomplished by positioning the blade in the mold prior to injecting the material forming the handle and head. Once molded, the blade is permanently held in the knife.

To use the knife, a user first grasps the elongated handle so that the first blade is oriented away from a user, preferably in a downward direction. In an embodiment where an opposing first blade and second blade are present, changing the orientation of the knife will generally not be necessary. Once grasped, the first blade is pressed against the container in a manner that punctures the container. Typically this involves pressing the blade into a strip of tape holding together two panels of the container, as in a sealed cardboard box. Once the container is punctured, the user draws the knife across the container in the direction of the elongated handle.

Due to the knife's curved head, a user can adjust the elongated handle to a preferred angle relative to the container, and as a consequence adjust the depth the first blade or the second blade penetrates into the container. To cut into thick or hard materials that resist cutting, the user may press a thumb against an application point on the elongated handle to drive the blade downward as mentioned above. The central area can also be made having a cutout into which a user inserts a finger, thereby providing additional drawing force and control for a more accurate cut, including cutting in a curve or arc. Alternatively, the central area can be a web which the user bears his index finger against for accurately guiding the blade across the work piece. Since the knife may be molded such that two opposing blades are implanted firmly in the head, preferably by placing two blades in the injection mold, the knife may be turned over to use the second blade upon dulling of the first blade.

Figure 1:
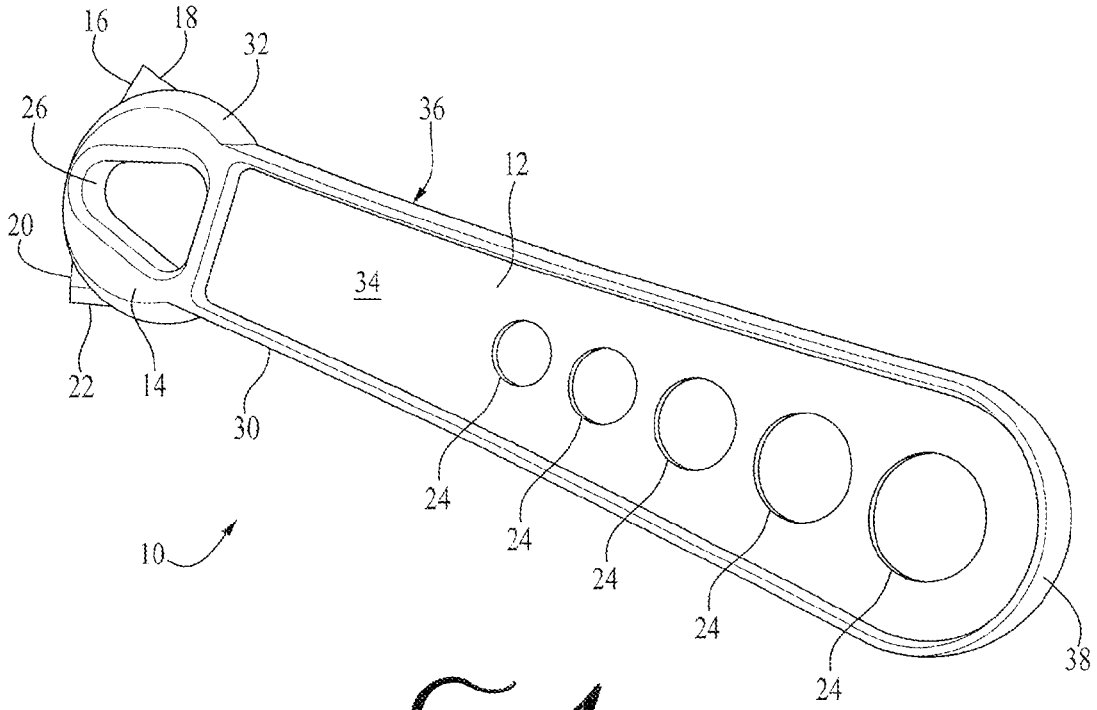
FIG. 1 is a perspective view of a first embodiment of the present utility knife.

REFERENCE NUMBERS $1^{st}$ embodiment knife 10
handle 12
rounded head 14 blade 16
cutting edge 18
blade 20
cutting edge 22
handle cutouts
central area 26
flange (ribbing) 30
radiused edge 32
web 34
application point 36
butt 38
$2^{nd}$ embodiment knife 40
handle 42
head 44
blade 46
cutting edge 48
handle cutouts 50
central area 57
flange (ribbing) 54
radiused edge 56
web 58
application point 60
butt 66
$3^{rd}$ embodiment knife 70

DESCRIPTION

A first embodiment of the utility knife 10 can be seen in FIG. 1. The utility knife 10 is preferably injection molded, with the handle 12, rounded head 14, and the blades 16, 20 molded as a single unit. The handle 12 has a thin web 34 in the central portion, surrounded by a flange 30 or other ribbing about the perimeter of the handle 12. The flange 30 design provides a handle 12 constructed of minimal material, yet providing significant strength to resist bending in the plane parallel to the blades 16, 20. may mark a potential force application point 36 on the handle 12, where the user may apply her thumb with fingers wrapped about the handle when cutting with blade 20.

The illustrated orientation of the flange 30 provides maximum bending stiffness when the load is applied as illustrated with the potential force application point 36. Since the web 34 mainly resists shear forces while the flange 30 resists bending, the web 34 may be made substantially thinner than the flange 30 and can include one or more through holes 24. The through holes 24 do not significantly reduce strength, yet save material and weight. The butt end 38 of the handle 12 is rounded, with the handle 12 tapering down towards the rounded head 14. The taper of the handle 12 aids in grasping the knife 10 during a draw cut, as the enlarged butt 38 prevents slipping.

Looking now at the rounded head 14 portion of the knife 10, two blades 16, 20 extend from the head 14 and are positioned on opposing sides of the head 14. In this particular example, if the first blade 16 were to be considered to lie in a second quadrant of the rounded head 14, the second blade 20 would lie within an adjacent third quadrant, like the quadrants in a standard circle, with zero degrees being straight back towards the butt 38 in the disclosed view. In this example, the cutting edge 18 of blade 16 is located in the second quadrant, just forward of the ninety degree mark. Likewise, the cutting edge 22 of the blade 20 is located in the third quadrant, just forward of the two-hundred and seventy degree mark.

The portion of the blade 16, 20 extending from the head 14 has a triangular profile, with the respective cutting edges 18, 22 being located on the trailing edge or the edge closest to the butt 38. The angle of the cutting edges 18, 22 are arranged to provide an optimal cutting angle as the knife 10 is held by the handle 12 and drawn back. The rounded head 14 has a centrally located triangular central area 26. Its triangular shape permits thickened areas on the head 14 to coincide with the location of the blades 16, 20 held within the head. Thus, additional material is provided to securely hold the blade within the head, while saving material and weight. The central area 26 may be hollow as shown, or may be solid and of substantially the same thickness as the web 34 (as shown at ref. no. 52 in the embodiment depicted in FIGS. 2 and 3).

The shape of the rounded head 14 is optimized to permit efficient cutting, without snagging. For example, when using blade 20 to make a cut, the user grasps the handle 12 with the thumb on or near application point 36. The blade 20 is placed atop a cutting surface. The user may adjust the angle of the handle 12 relative to the cutting surface. Since the cutting edges 18, 22 are positioned on the forward two quadrants as explained above, a low cutting angle, with the user's hand close to the cutting surface, creates a very shallow cut, since the crest of the rounded head exposes only a small portion of the cutting edge 22 to the cutting surface (cardboard, etc.). The user can increase the angle of the handle 12 relative to the cutting surface to deepen the cut, where the maximum depth is the full exposed height of the blade 16 that extends above the radiused edge 32.

The rounded profile of the head 14 permits smooth dragging across the cutting surface, which is crucial as the user applies significant pressure on the cutting surface through the head 14. Further, the edge of the rounded head 14 is a radiused edge 32. The radius permits the user to lean the handle to the side to make an angled cut, while maintaining a smooth draw. The user will often be rushed in making a cut, and has little time to insure a perfectly level cutting angle. So, the radiused edge 32 permits a wide variety of cutting angles with minimum effort.

In use, the user presses the blade 20 to puncture the cutting surface. Then, the user draws the knife back, generally in the direction of the butt 38 of the handle 12. The user may grasp the handle 12 in a variety of ways. With the central area 26 cut out a user may insert a finger into the central area 26 thereby providing additional drawing force and control. As one blade 20 dulls, the user can simply flip the handle 12 to expose the other blade 16 to the cutting surface. Further, since there are two opposing blades 16, 20, the user can quickly grab the knife 10 without looking at the knife 10 orientation, and quickly make a cut knowing that a blade 16 or 20 is in position to cut.

The knife 10 is preferably manufactured using known plastic injection insert molding techniques. where thermoplastic is molded around one or more metal blade inserts. The blade inserts are positioned in the injection mold, such that the root of each blade extends into the mold cavity. Thermoplastic material is injected to create the handle 12 and head 14, with the root of the blade firmly implanted into the head 14 to create a strong, integrated assembly. It is preferred that the blades 16,20 be hardened to permit extended use.

Figure 2:
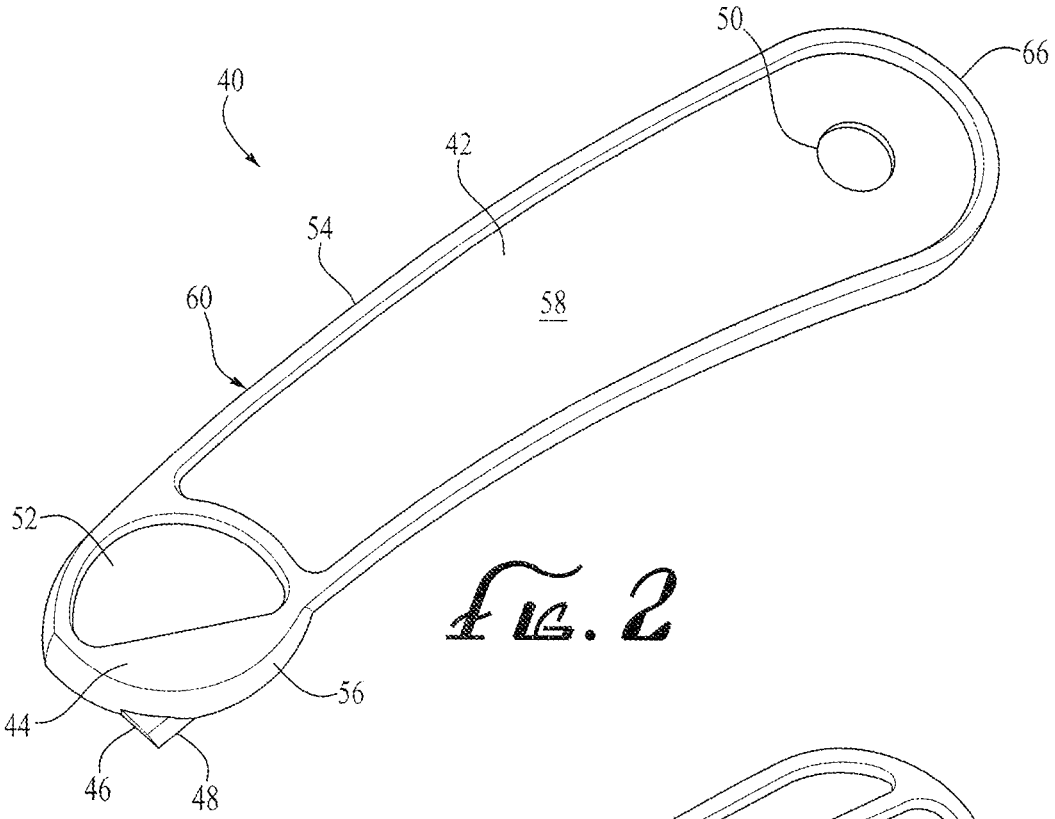
FIG. 2 is a perspective view of a second embodiment of the present utility knife.
Figure 3:
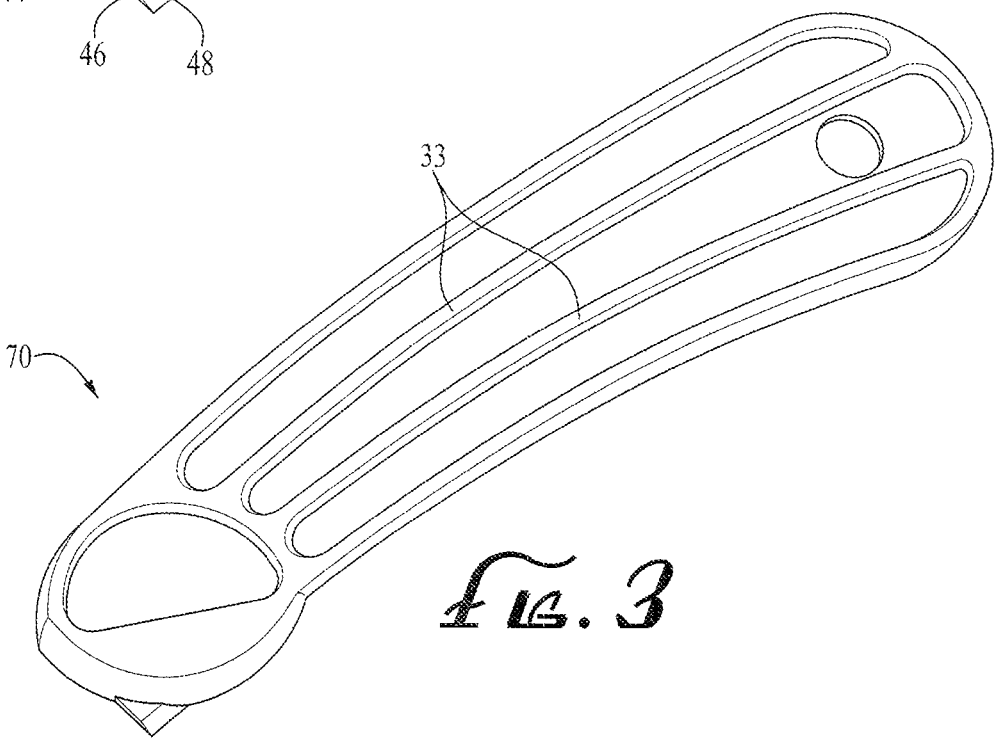
FIG. 3 is a perspective view of the first embodiment utility knife with ribs to prevent lateral bending.

A second preferred embodiment is shown in FIGS. 2 and 3, which illustrates a knife 40 with a single blade 46 molded into the head 44. The second embodiment is substantially similar to the first embodiment, except certain features have been modified for single blade use. The handle 42 has a flange 54 extending about the perimeter, with a web 58 within a central area. Of course, as shown on an alternative, third embodiment knife in FIG. 3, additional ribbing or flanges 33 may be included to provide bending resistance in other directions.

A through hole 50 is provided to save material and weight, and provide a hanging point for storage. The head 44 is uniformly rounded with a half-moon shaped central area 52. The central area 52 may be a solid web, of substantially the same thickness as the web 58 as shown, or may be cut out (as shown at ref. no. 26 in the embodiment depicted in FIGS. 2 and 3) according to preference. The shape of the central area 52 allows an adjacent thickened section for mounting the blade 46 with cutting edge 48 facing away from the central area 52. As described above, the handle 42 can be grasped, with the thumb applying pressure at application point 60. To guide the knife, a user may also place an index or other finger against the central area 52 of the head 44.

The present knife provides an inexpensive and light-weight design, that is molded in a single shot, and requires no assembly. Since there are no separate parts, loose parts and blades cannot migrate into unsafe locations or final product. The blade and head design prevents cutting at an excessive depth, preventing damage to product while cutting the packaging. By inserting a finger through the central area 26 of the first embodiment, or against the central area 52 of the second embodiment, the knife encourages control for precision cuts.

The foregoing description of the preferred embodiment of the Invention is sufficient in detail to enable one skilled in the art to make and use the invention. It is understood, however, that the detail of the preferred embodiment presented is not intended to limit the scope of the invention, in as much as equivalents thereof and other modifications which come within the scope of the invention as defined by the claims will become apparent to those skilled in the art upon reading this specification.

What is claimed is:

1. A draw cut utility knife, comprising:

an elongated handle for grasping the knife and a head integrally formed at one end of the handle in the longitudinal direction of the handle and away from a butt end of the handle holding a first blade;

the elongated handle having a central portion surrounded by a flange portion extending around the perimeter of the central portion;

the central portion in planar alignment with the first blade;

the head having a central area of reduced thickness defining a web for receiving a user's index finger, the central area for guiding the first blade while;

the head having a rounded edge from which the first blade protrudes; and the first blade having a triangular profile extending away from the thickened portion opposite the central area, wherein the handle and the head are made of a thermoplastic material, and the first blade is permanently embedded in the thermoplastic material.

2. The knife of claim 1 wherein the central portion has a cut out.

3. The knife of claim 1 wherein the elongated handle narrows proximate the head.

4. The knife of claim 1 wherein the flange portion has an indicator marking a force application point on the elongated handle.

5. The knife of claim 1 wherein the head has a first thickened portion proximate the first blade.

6. The knife of claim 1 wherein the first blade has a rearward sharpened edge facing the elongated handle of the knife.

7. The knife of claim 1 farther comprising a second blade secured to the head.

8. The knife of claim 7 wherein the second blade has a rearward sharpened edge facing the elongated handle of the knife.

9. The knife of claim 7 wherein the second blade is secured opposite the first blade on the head.

* * * * *